US006028992A

United States Patent [19]

Henriot et al.

[11] Patent Number: 6,028,992

[45] Date of Patent: Feb. 22, 2000

[54] METHOD FOR CONSTITUTING A MODEL REPRESENTATIVE OF MULTIPHASE FLOWS IN OIL PRODUCTION PIPES

[75] Inventors: Véronique Henriot, Rueil-Malmaison; Pierre Duchet-Suchaux, Paris; Claude Leibovici, Pau; Isabelle Faille, Carrière-sur-Seine; Eric Heintze, Meudon, all of France

[73] Assignee: Institut Francais Du Petrole, Rueil-Malmaison, France

[21] Appl. No.: 08/971,165

[22] Filed: Nov. 14, 1997

[30] Foreign Application Priority Data

Nov. 18, 1996 [FR] France ..... 96 14124

[51] Int. Cl.[7] ..... G06G 7/48; G06G 7/57

[52] U.S. Cl. ..... 395/500.3; 395/500.23; 395/500.26

[58] Field of Search ..... 364/578; 395/500.3, 395/500.31, 500.23, 500.26

[56] References Cited

U.S. PATENT DOCUMENTS 5,550,761 8/1996 Pauchon ..... 364/578
5,801,969 9/1998 Nagahama ..... 364/578

OTHER PUBLICATIONS

*Society of Petroleum Engineers* (SPE #21755), Mar. 20, 1991, entitled "Compositional Reservoir Simulation, A New, Efficient, Fully Integrated Solution Technique for the Flow/Thermodynamic Equilibrium Equations" by F.M. Guehria et al, pp. 55–68 (XP002035429).

*Primary Examiner*—Kevin J. Teska
*Assistant Examiner*—Hugh Jones
*Attorney, Agent, or Firm*—Antonelli, Terry, Stout & Kraus, LLP

[57] ABSTRACT

The invention provides a model representative of steady and transient flows, in a pipe, of a mixture of multiphase fluids, which takes account a set of variables defining the properties of the fluids and of the flow modes having separate phases which are dispersed and intermittent, and the dimensions and slope of the pipes. The modeled quantities characterizing the flow are determined by solving a set of transport equations, an equation of mass conservation per constituent and an equation of momentum of the mixture, and by using a hydrodynamic model and a hydrodynamic model of the fluids. The models are formed by considering the mixture to be substantially at equilibrium at all times and that the constituents of the multiphase mixture are variable all along the pipe. The method can be applied to hydrocarbon transportation network study and to determination of characteristics of flow of the multiphase mixture in the pipe.

7 Claims, 3 Drawing Sheets

METHOD FOR CONSTITUTING A MODEL REPRESENTATIVE OF MULTIPHASE FLOWS IN OIL PRODUCTION PIPES

BACKGROUND OF THE INVENTION

1. Field of the Invention

The present invention relates to a method for modelling steady and transient flows, in pipes, of a mixture of multiphase fluids.

2. Description of the Prior Art

It is well-known that the flow modes of multiphase fluids in tubes are extremely varied and complex. Two-phase flows for example can be stratified, the liquid phase flowing through the lower part of the pipe, or intermittent with a succession of liquid and gas slugs, or dispersed, the liquid being carried in the form of fine droplets. The flow mode varies notably with the slope of the pipes with respect to the horizontal and it depends on the flow rate of the gas phase, on the temperature, etc. The slippage between the phases, which varies according to whether the ascending or descending portions are considered. leads to pressure variations without there being compensation. The characteristics of the flow pattern (dimensioning, pressure, gas flow rate, etc.) must be carefully determined.

Examples of the many publications focused on the behaviour of flows, notably two-phase flows, in pipes are:

Fabre J. et al, 1983, Intermittent Gas-Liquid Flow in Horizontal or Slightly Inclined Pipes, Int. Conference on the Physical Modelling of Multi-Phase Flow, Coventry, England, p.233–254, or Fabre J. et al, 1989, Two Fluid/Two Flow Pattern Model for Transient Gas Liquid Flow In Pipes, Int. Conference on Multi-Phase Flow, Nice, France; P269–284, Cranfield, BHRA.

An existing modeling method deals with phase chances by iterative processes. The state of the mixture is supposed to be known a priori and if this leads to inconsistencies after hydrodynamic calculations, the calculations are repeated with a new state of the mixture. This method requires considerable processing and can be the source of convergence problems.

A modeling method applied to porous media is described for example by Eymard R., Gallouët T., 1991, Traitement des Changements de Phases dans la Modélisation de Gisements Pétroliers, Journées Numériques de Besancon, 23–24 September 1991.

U.S. Pat. No. 5,550,761 describes a method for modeling steady or transient multiphase flows that accounts for a set of variables defining the properties of the fluids and of the flow modes, and also of the dimensions and the slopes of the feed pipes. The quantities characterizing the flow are determined by solving a set of transport equations with an equation of mass conservation per phase and an equation of momentum of the mixture, and by using a hydrodynamic model and a thermodynamic characteristic of the fluids.

To obtain this hydrodynamic model, the flow regimes are characterized by a parameter ranging between 0 and 1 and representative of the fraction of the flow that is in a separate state (the phases are stratified vertically or radially for example), any flow regime is determined while solving the transport equations by comparing the current value of the liquid fraction in the slugs and that of the areas with a dispersed flow mode, the velocity of the slugs of the gas phase are also determined with respect to a critical velocity, and continuity constraints are imposed on the boundaries between regimes, on the gas volume fractions and on the slug displacement velocity during solution of closing relations.

In the previous method, an approach "by phase" (liquid-gas) was selected where mass conservation is expressed by an equation of conservation per phase and mass transfer between phases is expressed by an imbalance term proportional to the difference between two vapour mass fraction values, one $fmva_{eq}$ corresponding to equilibrium, which is provided by thermodynamics with a constant global composition, the other being calculated by taking account of the slippage between the phases $$m_G = AKGL \cdot \left( fmva_{eq} - \frac{\rho_G \cdot R_G \cdot V_G}{\rho_G \cdot R_G \cdot V_G + \rho_L \cdot R_L \cdot V_L} \right)$$

where AGKL is a factor depending a priori on the fluid and on the flow pattern.

It has been noticed with practice that it is difficult to define a formulation of this imbalance term which applies to all situations: local slopes of pipes with upper and lower points, considerable mass transfers between phases. There is no reliable and robust method which correctly accounts for the imbalance term between phases; the liquid-gas approach "by phase" gives no satisfactory results in cases where considerable transfers occur between phases.

SUMMARY OF THE INVENTION

The modeling achieved with the method according to the invention accounts for mass transfer phenomena between phases and of the momentum between the phases of the mixture, from a set of variables defining the properties of the fluids, the flow modes thereof and also variations in the slope of pipes with respect to the horizontal. The model facilitates the design of petroleum effluent transfer networks for example.

The method according to the invention is also suitable for modeling the behaviour of multiphase mixtures of hydrocarbons circulating in pipelines from reservoir development sites to loading or processing sites for example.

In order to model steady and transient flows in pipes of a multiphase mixture, which accounts for a set of variables defining the properties of the fluids and the flow modes of separate phases, dispersed, intermittent, and of the dimensions and slopes of the feed pipes, the method according to the invention comprises using a hydrodynamic model of the drift flow type and a thermodynamic model defining the properties of the constituents, and solving a set of equations of mass conservation per constituent, of mixture momentum conservation and of energy transfer in the mixture.

The method according to the invention provides a model formed by considering that the mixture is substantially at equilibrium at all times and that the composition of the multiphase mixture is variable all along the pipe, the mass of each constituent of the mixture is defined globally by a mass conservation equation regardless of the phase state thereof, and in that a time explicit numerical scheme is used in order to facilitate solution of the model equations.

Consideration of appearance and disappearance of the phases is made simpler by this composition approach because the mass of each constituent is considered globally without taking account phase states (single-phase or multiphase). Difficulties linked with the previous approach "by phase", where there is one conservation equation per phase and therefore where the number of mass conservation equations varies with each change of state of the constituents according to whether a phase appears or disappears, are thus avoided.

The method of the invention accounts for phase appearance and disappearance phenomena without encountering solution convergence problems that sometimes occur with existing methods, which provides code robustness.

According to an embodiment of the invention, solution of the energy transfer equations uncoupled from mass conservation and momentum is provided.

The invention solves energy transfer equations uncoupled from those relative to mass conservation and momentum, and it preferably comprises using a time explicit numerical scheme, which usefully results in that the masses of each of the constituents being the result of the numerical scheme without any iterative use of the hydrodynamic model. Knowing the masses of the constituents and the temperature, the integrated thermodynamic model determines the pressure and the composition of the mixture, and notably the volume fraction of the phases. Detection of the appearance and disappearance of the phases is thus made more robust.

With uncoupling, solving simultaneously the thermodynamic model and the hydrodynamic model is thus spared. Possible conflicts due to the fact that the solutions respectively provided by these models are a priori equally pertinent and difficult to match with each other are thus avoided. As a result, detection of phase appearance and disappearance phenomena is simple and robust.

According to an embodiment of the invention, the method comprises a multi-component mixture, such as a petroleum fluid flowing through pipes being represented, as a mixture comprising a limited number of components and for example as an equivalent binary mixture (with two constituents) having substantially the same phase envelope as the real mixture, so that the constitution of the composition model becomes less complex.

The method advantageously comprises using an integrated module for determining the thermodynamic parameters (phase equilibrium and transportation properties), which gives more representative results than those taken from precalculated charts.

BRIEF DESCRIPTION OF THE DRAWINGS

Other features and advantages of the method according to the invention will be clear from reading the description hereafter of embodiments given by way of non limitative examples, with reference to the accompanying drawings wherein.

DESCRIPTION OF THE PREFERRED EMBODIMENTS OF THE INVENTION

I) Unknowns and equations

Figure 1:
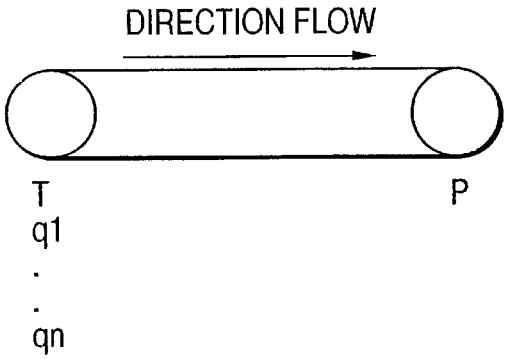
FIG. 1 shows the boundary conditions taken into account.

Realization of the model of a mixture with n components, p phases, comprises solving equations of mass conservation for each of the constituents, of conservation of the momentum of the mixture and of the energy of the mixture, that will be defined hereafter, by denoting the various parameters as follows I.1) Unknowns:

$x_j^i$: mass fraction of component i in phase j $c_i$: total mass fraction of component i $R_j$: volume fraction of phase j $V_j$: velocity of phase j (m/s)

P: pressure (Pa)

T: temperature (K)

$H_j$: specific enthalpy of phase j $\rho_j$: density of phase j (kg/m$^3$)

$T_w$: wall friction (Pa/m)

$Q_w$: term of heat exchange on the wall (W/m$^3$)

θ: angle of the pipe with respect to the horizontal $$V_M = \frac{\Sigma\rho_j R_j V_j}{\Sigma\rho_j R_j} : \text{ barycentric velocity of the mixture}(m/s)$$

$\rho = \Sigma\rho_j R_j$ average density of the mixture (kg/m$^3$)

$$X_j = \frac{\rho_j R_j}{\rho} \text{mass fraction of phase } j$$

g: acceleration of gravity (m/s$^2$)

S: fluid flow surface (m$^2$)

W: conservative variables

F: flux of the numerical scheme

Q: source terms.

In the composition approach according to the invention, the mass conservation is checked for each constituent. The mass transfer between phases does not appear explicitly in these equations but it is taken into account insofar as the fluid is described as a mixture of variable composition along the pipe. The mixture is supposed to be at equilibrium at all times.

I.2) Definitions

The following abbreviated forms are used in the description hereafter: "Flash" refers to an integrated subroutine for calculating the thermodynamic properties (liquid-vapour equilibrium, composition of each of the phases) by means of an equation of state;

"Flash (P,T)" is a "flash" carried out when the global composition of the mixture, the pressure and the temperature are known;

"Flash (T,V)" is a "flash" carried out when the global composition of the mixture, the temperature and the mass of each constituent are known, with determination of the pressure during the calculation, so that the masses are confirmed;

"Flash (P,H)" is a "flash" carried out when the global composition of the mixture, the pressure and the total enthalpy are known, with determination of the temperature during the calculation, so that the enthalpy is confirmed.

I.3) Equations

The conservation equations processed are the following a mass conservation equation for each constituent i:

$$\frac{\partial}{\partial t}(\Sigma\rho_j R_j x_j^i) + \frac{\partial}{\partial x}(\Sigma\rho_j R_j x_j^i V_j) = 0$$

an equation of momentum conservation of the mixture:

$$\frac{\partial}{\partial t}(\Sigma\rho_j R_j V_j) + \frac{\partial}{\partial x}(\Sigma\rho_j R_j V_j^2 + P) = T_w - (\Sigma\rho_j R_j)g \cdot \sin\theta$$

an equation of energy of the mixture:

$$\frac{\partial}{\partial t}\left(\sum_j \rho_j R_j H_i\right) + \frac{\partial}{\partial x}\left(\sum_g \rho_j R_j V_j H_j\right) = \frac{\partial \rho}{\partial t} + (\Sigma R_j V_j)\frac{\partial P}{\partial x} + Q_w + V_M T_w$$

where $Q_w$ is the term of energy flow on the wall.

To take account of the composition approach selected, it is also imposed that:

$$\sum_{i=1}^{n} x_j^i = 1 \quad \forall\, j$$

$$c_i = \frac{\sum_{j=1}^{P} \rho_j R_j x_j^i}{\sum_{j=1}^{P} \rho_j R_j}$$

$$\sum_{j=1}^{P} R_j = 1$$

As for boundary conditions, the mass flow rate of each constituent and the temperature can for example be imposed upstream and the pressure downstream.

Thermodynamic behaviour of the mixture

Application of the laws of thermodynamics permits obtaining the physical properties of the fluid necessary for the composition code.

For a given pressure, temperature and global composition, thermodynamics allows the mass fractions of each component in each of the phases to be known. In addition, it allows calculation of density of each of the phases present and to deduce the volume proportions of each of the phases in the global mixture, and thus to detect if the mixture is a two-phase, a liquid single-phase or a gas single-phase mixture. Elementary laws defined hereafter permit calculation of transport properties of each phase: viscosity, heat conductivity, specific heat, specific enthalpy, interfacial tension.

The global thermodynamic law (calculation of the equilibrium and properties of the mixture) is written as follows $$\begin{pmatrix} x_j^i \; i = 1, n \\ j = 1, \rho \\ \text{transport properties} \\ \text{thermal properties} \end{pmatrix} = \Gamma_{thermo}(P, T, c_1, \ldots, c_{n-p+1})$$

Hydrodynamic law

In the case of a mixture, the hydrodynamic behaviour is determined by the extent of the slippage between the phases present, i.e. by the difference between the velocities of the gas phase and of the liquid phase in the case of a two-phase mixture. Slippage depends on the thermodynamic properties of the fluids, on the mass fraction of gas, and on the average velocity of the mixture. It is calculated by a function called hydrodynamic function which also determines the flow pattern and the friction terms. This function is written as follows:

$$\Phi(V_M, X_j, \Gamma_{thermo}, dV_{ij}) = 0$$

$$\text{where } dV_{ij} = V_i - V_j.$$

The following known closing laws are for example used to constitute the physical model suitable for a two-phase flow:

For a wall friction, Churchill type friction coefficients are used for turbulent flows and Poiseuille type friction coefficients are used for laminar flows;

for interfacial friction, a law similar to that proposed by Andritsos N. and Hanratty T. J., 1987, Influence of Interfacial Waves in Stratified Gas-Liquid Flows, AiChe J., Vol.33, p.444–454, is used;

for bubble diameters, a law of the type proposed by Hinze J. O., 1955. Fundamentals of the Hydrodynamic Mechanism of Splitting in Dispersion Processes, AiChe J., Vol. 1, p.289–295, is used; and for the volume fraction of gas in liquid slugs, a law inspired by Andreussi P., Bendiksen K., 1989, An investigation of Void Fraction in Liquid Slugs for Horizontal and Inclined Gas-Liquid Flow, Int. J. Multiphase Flow, Vol.15-2, p.937–946, is used.

Thermal model

The term $Q_w$ in the thermal transfer equation corresponds to the exchange term due to the contribution of the various thermal transfer modes: conduction through the pipe (wall and insulants), convection within the fluid and exchange between the fluid and the surrounding medium (air, ground or sea). For convection within the fluid, the flow pattern is taken into account.

II) Physical properties of the fluids

In order to characterize the mixtures, their characteristic quantities are classified into three groups Information resulting from the study of equilibrium between the phases:

- state of the mixture (p-phase, three-phase, two-phase, single-phase gas or single-phase liquid);
- mass fractions of each component in each of the phases and volume proportion of each phase in the mixture; and
- densities of each of the phases.

Transport properties (useful for hydrodynamic solution)

- viscosities of each of the phases; and
- interfacial tension.

Useful properties for modeling heat transfers:

- mass enthalpies of each phase;
- thermal conductivities in each phase; and
- specific heats of the phases.

The following tools can be used for thermodynamic modeling:

a) correlations, i.e. simple laws allowing quantitative representation of physical phenomena, which have the advantage of being saving of calculation time, or b) properties calculated from a complete thermodynamic program with solution of an equation of state : either by means of a chart filled by a previous processing, or by means of an integrated "flash" every time the characteristics of the fluid are needed.

Presentation of correlations

The physical properties: densities p, viscosities and interfacial tensions σ are calculated by means of simple algebraic formulas. For example, in the case of a gas-liquid two-phase mixture, the behavior of the gas will be close to that of a perfect gas and the following relations will be used:

$$\rho_G = \rho_{GNorm} \cdot \frac{P \cdot T_{Norm}}{P_{Norm} \cdot T}$$

$$V_G = V_{GNorm}$$

$$\rho_L = \rho_{LNorm} + \frac{P - P_{Norm}}{a_L^2}$$

$$V_L = V_{LNorm}$$

$$\sigma = \sigma_{Norm}$$

The values $\rho_{GNorm}$, $P_{Norm}$, $T_{Norm}$, $\rho_{LNorm}$, $V_{GNorm}$, $V_{LNorm}$, $a_L^2$, $\sigma_{Norm}$ are provided by the user, for each simulation, so as to best represent the behaviour of the fluid modeled.

Equilibrium coefficients

The mass fractions of liquid and of gas of each of the constituents are not directly modeled but the equilibrium coefficients $K_i$, $$K_i = \frac{P_i^0}{P}$$

for each constituent, where $P^0_i$ is the saturation pressure, at a given temperature, of component i are directly modeled.

Phases appearance and disappearance

To determine the state of the mixture, two concepts are taken into account the bubble-point pressure and the dew-point pressure. The bubble-point pressure and the dew-point pressure can be readily calculated for a given composition. The state of the mixture then depends on the pressure value the mixture is a two-phase mixture if $P_{dew}<P<P_{bubble}$ the mixture is a single-phase gas mixture if $P<P_{dew}$ the mixture is a single-phase liquid mixture if $P>P_{bubble}$.

Property calculation after the flash

To calculate the physical properties, the known Peng-Robinson thermodynamic model with volume translation, [well-known to specialists,] is for example used. The viscosities are calculated by means of the Lohrentz Bray Clarck method, the specific heats at constant pressure and the enthalpies by the Passut and Danner method, which is polynomial as a function of the temperature and uses seven coefficients, the interfacial tension by the parachor method, these parachors and the characteristic exponent being calculated by means of the Broseta method, all these methods being well-known and described for example in the following publications:

Broseta D. et al, 1995, Parachors in Term of Critical Temperature, Critical Pressure and Acentric Factor, SPE Annual Technical Conference and Exhibition, Dallas, USA, 22–25 Oct. 1995;

Passut C. A. et al, 1972, 1 & EC, Process des. dev., 11, 543 (1972);

Péneloux A. et al, 1982. A consistent Correction for Redlich-Kwong-Soave Volumes, Fluid Phase Equilibria, 8 (1982), p.7–23, Elseviers Science Publishers (Amsterdam); and Peng D. Y. et al, 1976, A New Two-Constant Equation of State. Ind Eng. Chem. Fund. 15, 59–64 (1976).

Representing mixtures as a mixture with a limited number of components

As we have seen above, an important characteristic of the method according to the invention is that it offers the possibility of representing multi-constituent mixtures such as petroleum fluids, for example, as a mixture of a more limited number of pseudo-constituents whose properties are as close as possible to those of the real mixture, from the detailed description of the composition of a complex mixture, for example as a binary mixture of two pseudo-constituents.

Using properties charts

Integrated "flashes" are preferably used notably concerning determination of the vapor mass fraction, especially in the case of fluids with more than two constituents, which give much more representative results than thermodynamic properties charts pre-filled by means of a calculation program on the basis of the binary description of the fluid.

III) Approximate determination of the steady state

An approximate calculation of the initial steady state is carried out prior to any simulation. This calculation reduces the convergence time in order to reach a steady state in accordance with the numerical scheme by starting from a solution close to the real initial state.

To obtain this state, the equations are solved without taking into account the time derivative terms and independent of inertia terms in the momentum equation. The data used are the boundary conditions shown in FIG. 1, where T is the temperature, q1, . . . , qn the mass flow rates of the constituents and P the pressure.

The following system of equations is solved $$\sum_{j=1}^{P} \rho_j R_j V_j x_j^i = q^i / S \text{ pour } i = 1 \ldots n$$

$$\frac{\partial P}{\partial x} = T_w - (\Sigma \rho_j R_j) \cdot g \sin\theta$$

$$\frac{\partial}{\partial x} \Sigma \rho_j R_j H_j V_j = \Sigma (R_j V_j) \cdot \frac{\partial P}{\partial x} - Q_w + V_M T_w$$

$$\Phi(V_M, x_i, \Gamma(P, T, c_i, \ldots, c_{n-p+1}), dV) = 0$$

$$\begin{pmatrix} x_j^i \\ \text{transport properties} \\ \text{thermal properties} \end{pmatrix} = \Gamma_{thermo}(P, T, c_1, \ldots, c_{n-p+1})$$

The unknowns of the problem thus set are: P, T, $c_1$, . . . , $c_{n-p+1}$, $R_j$, $dV_{ij}$, $V_j$.

Figure 2:
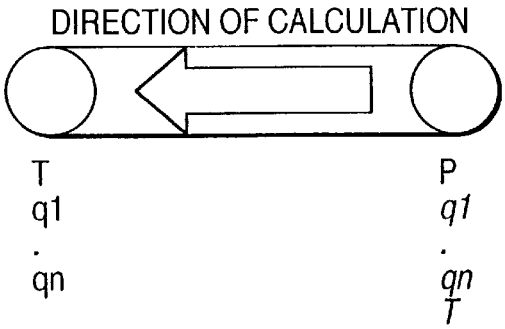
FIG. 2 illustrates the approximate stationary calculating method in cases where the temperature is known.

The process followed carries out a first calculation from downstream to upstream, which determines the upstream pressure for an imposed temperature profile. Only hydrodynamic and thermodynamic calculations are performed. Starting from downstream (FIG. 2), the pressure is imposed, the flow rates are known (equal to the upstream flow rates), the temperature is imposed (case of imposed profile, or estimated in the opposite case).

Figure 3:
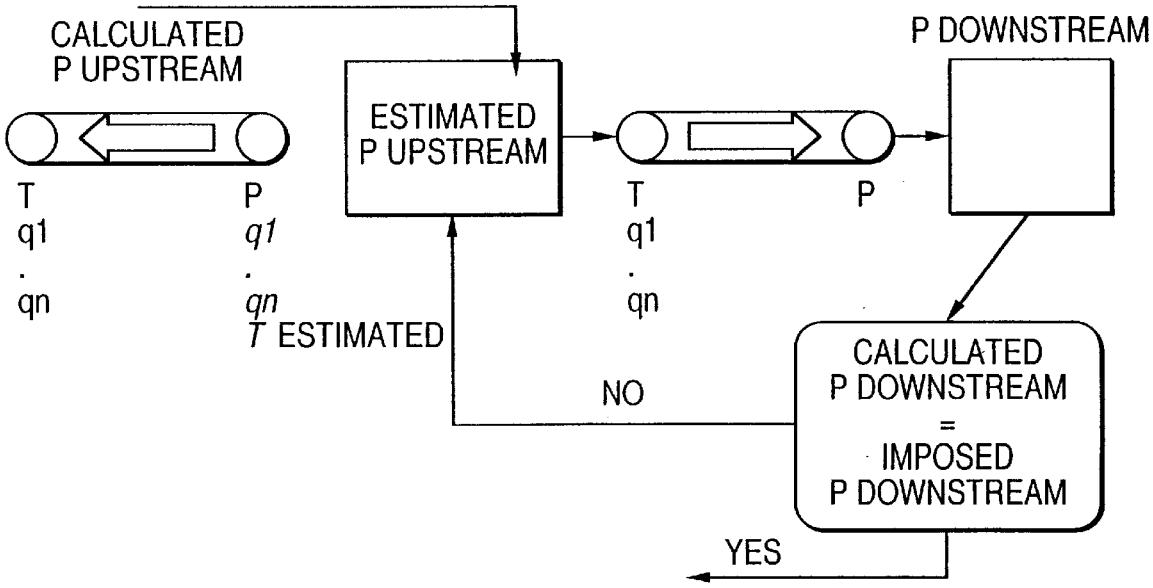
FIG. 3 shows the general algorithm of the stationary calculation in cases where temperature calculation is required.

If the temperature profile must be calculated, the calculation algorithm is:

calculation from downstream to upstream after estimating a downstream temperature as a function of data relative to the pipe environment;

calculations from upstream to downstream carried out by estimating the upstream pressure and by carrying out thermodynamic, hydrodynamic and thermal calculations. Solution is achieved by means of a Newton type approximate calculation method from the upstream pressure in order to find the pressure imposed downstream, as represented in FIG. 3.

IV) Determination of unsteady states

Unsteady behavior is caused either by boundary limit variations in relation to an initial steady state, or by the irregular geometry of the terrain or of the plant which leads to unstable flows referred to as "terrain slugging" and "severe slugging".

Since the temperature varies much less than the pressure, the composition and the hydrodynamic quantities, it is possible to solve the heat exchanges by uncoupling the calculation from the mass conservation and momentum calculation.

The system (momentum, mass) can be solved by means of a known numerical scheme written in the form of finite volumes, time-explicit for example, of order 1 or 2 in space, as described by Roe P. L., 1980, "The use of Riemann problem in finite difference scheme", in Lecture notes of Physics 141.

The heat transfer equation is solved by means of a method known as the uncoupling characteristics method. As a result of uncoupling between thermal and hydrodynamic solution, the temperature is known at this stage of the solution.

The following conservative variables are considered:

$$\left.\begin{aligned} W_{ij} &= \Sigma\rho_j R_j x_j^i \\ W_{Mvt} &= \Sigma\rho_j R_j V_j \end{aligned}\right\}$$

The values of these quantities are given by Roe's numerical scheme defined above.

The system of equations to be solved is as follows:

$$\begin{cases} \left.\begin{aligned} W_i &= \Sigma\rho_j R_j x_j^i \\ W_{Mvt} &= \Sigma\rho_j R_j V_j \end{aligned}\right\} \\ \begin{pmatrix} x_j \\ \text{transport property} \\ \text{thermal properties} \end{pmatrix} = \Gamma_{thermo}(P, T, c_1, \ldots, - c_{n-p+1}) \\ \Phi(V_M, X_j, \Gamma_{thermo}, dV_{ij}) = 0 \end{cases}$$

Solution for the inner edges of the grid pattern:

The numerical scheme allows the hydrodynamic solution to be uncoupled from thermodynamic solution. The problem comes down to determining the physical quantities from the conservative quantities provided by the numerical scheme by means of the method described hereunder.

Knowledge of the masses of each constituent ($W_i$) allows determination of the mass concentration of each component i:

$$c_i = \frac{W_i}{\sum_{j=1}^{n} W_j}$$

Figure 4:
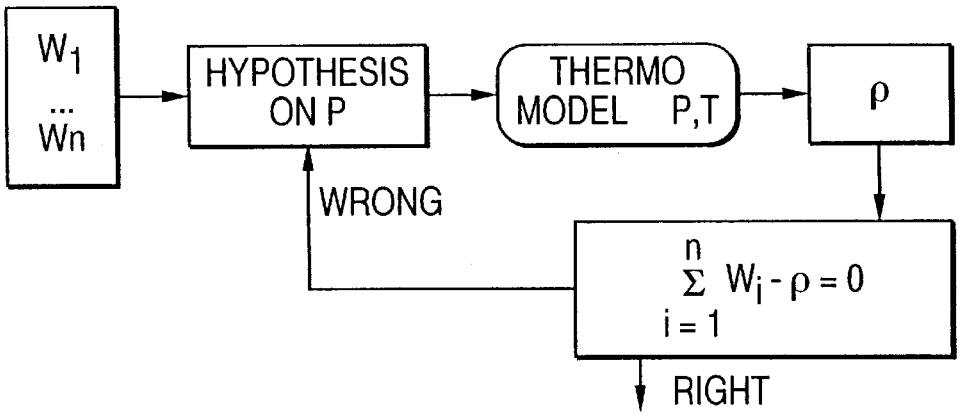
FIG. 4 shows the algorithm for determining the pressure knowing the masses of the constituents by using a flash with imposed pressures and temperatures.

Calculation of the pressure and of the thermodynamic properties:

It is possible to use here a standard method for carrying out iterative calculations of the pressure by using a "flash (P,T)" until the pressure leads to masses of each of the constituents equal to those provided by the numerical scheme, according to the flowchart of FIG. 4.

Figure 5:
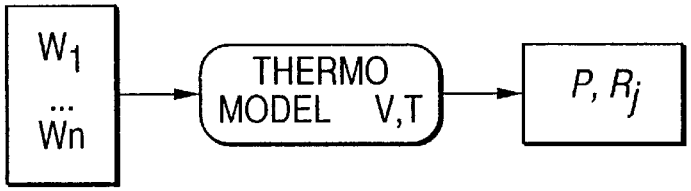
FIG. 5 shows the algorithm for determining the pressure knowing the mass of the constituents by using a flash with imposed volumes and temperatures.

Considerable calculating time gain is obtained when using a integrated "flash (P,T)", by imposing temperature and volume values (see flowchart of FIG. 5); iterations are carried out within the scope of thermodynamic calculations and they spare redundant calculations.

Applying the hydrodynamic function

Knowing the pressure and all the characteristics of the fluid, it is possible to calculate the barycentric velocity $$V_M = \frac{W_{Mvt}}{\rho},$$

Applying the hydrodynamic function $\Phi(V_M, X_j, \Gamma_{thermo}, dV_{ij})=0$ allows calculation of the velocities of the phases.

Figure 6:
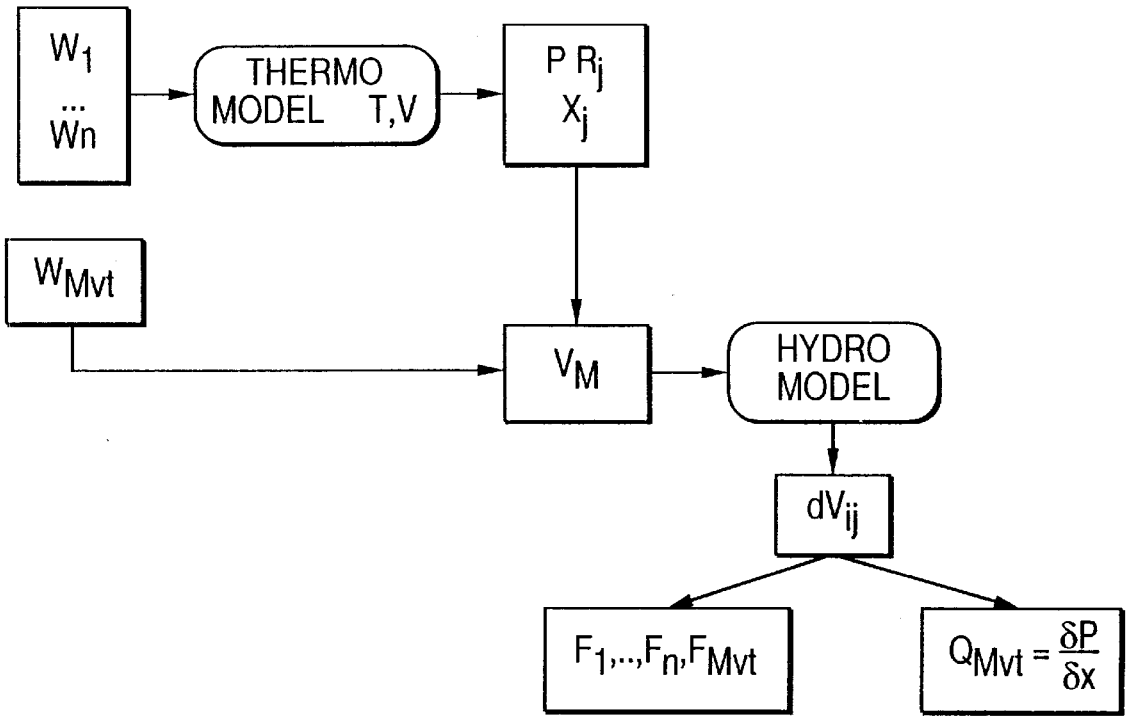
FIG. 6 shows the calculation algorithm allow determination of the quantities characterizing the flow from conservative quantities provided by the numerical scheme during transient calculation.

The solution of the hydrodynamic model is identical in the transient part and in the steady part. The general solution diagram allowing physical quantities to be obtained from conservative quantities is shown in FIG. 6.

Processing the boundary conditions

There are generally n positive eigenvalues and one negative eigenvalue:

$$\lambda_1<0<\lambda_2\leqq\lambda_3\leqq \ldots <\lambda_n$$

Downstream boundary condition

Generally, there is thus one incoming characteristic and n outgoing characteristics. The boundary condition expresses the incoming data. The pressure is imposed:

$$P-P_{downstream}=0.$$

N compatibility equations associated with the positive eigenvalues express the outgoing data:

$$\text{For } j = 1, n$$

$$\sum_{i=1}^{n} \alpha_{ij} W_i + \alpha_{Mvt} W_{Mvt} = Aj.$$

The hydrodynamic law and the thermodynamic law must also be confirmed.

The solution of the non-linear system thus obtained allows determination of the masses ($W_i$) and the momentum ($W_{Mvt}$).

Upstream boundary condition

Generally, there are n incoming characteristics and one outgoing characteristic. The boundary conditions, on the imposed flow rates $q_1, q_2, \ldots, q_n$ of each component, express the incoming data:

The equations to be confirmed are thus the following:

$$q_i-(\Sigma\rho jRjVjx_j^i).S=0 \text{ for } j=1 \text{ to } n.$$

The outgoing data is expressed by the compatibility equation associated with the negative eigenvalue:

$$\Sigma\alpha_i W_i+\alpha_{Mvt.} W_{Mvt}=\delta \qquad (3).$$

The hydrodynamic law and the thermodynamic law must also be confirmed.

The solution of the non-linear system thus obtained allows to determination of the masses ($W_i$) and the momentum ($W_{Mvt}$).

The various numerical solution stages concerning both the edges and the boundary conditions require partial derivative calculations. For reasons of robustness, accuracy and calculation time gain, most of the derivatives are calculated analytically, notably the thermodynamic quantities derivatives.

Transient thermal transfers

At this stage of the solution, the composition of the mixture and the pressure are known (solution of mass conservation and momentum).

Figure 7:
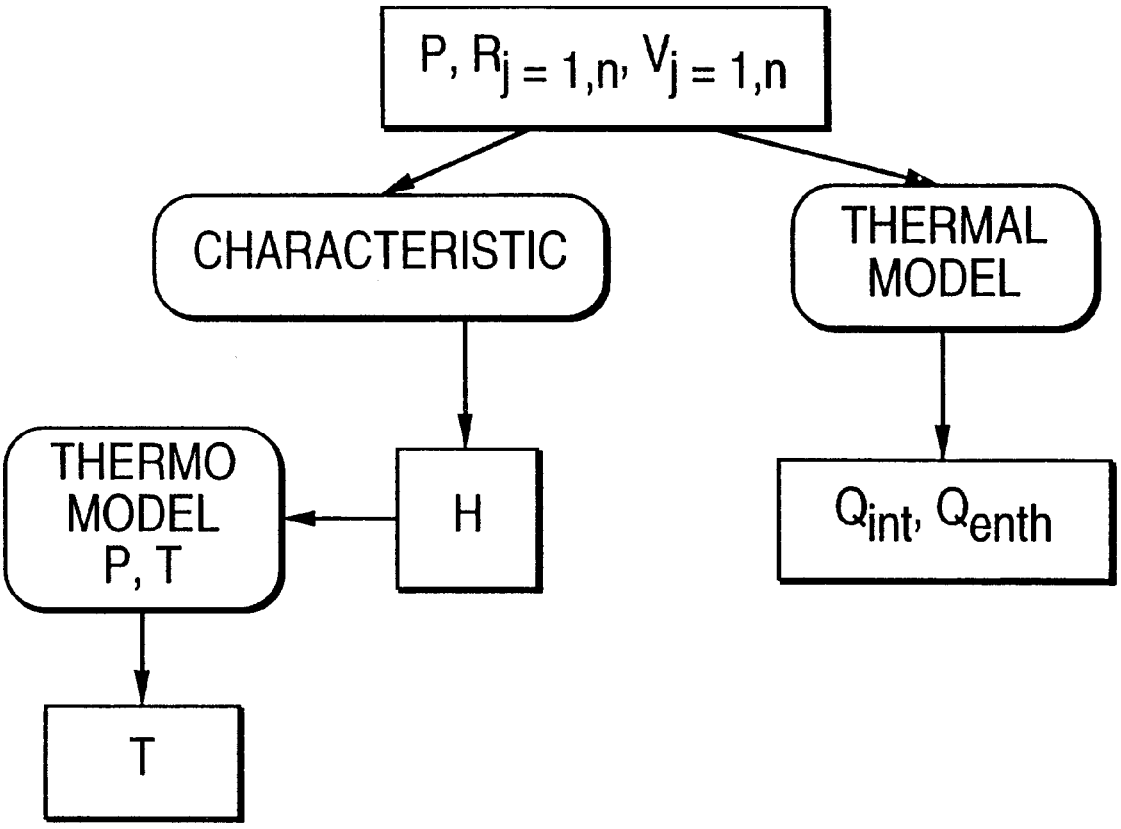
FIG. 7 shows the algorithm allowing to solve the heat transfer equations.

A characteristics method (FIG. 7) solves the thermal transfer equation; it provides the value of the mass enthalpy of the mixture.

Using the thermodynamic law allows the temperature to be defined:

the standard method uses successive recourses to a "flash (P,T)" by making the temperature evolve until the calculated enthalpy of the mixture is identical to that provided by the numerical scheme; and calculating time is saved by writing directly a "flash (P,H)". In this case, iterations are carried out within the thermodynamic model. The thermal model provides the thermal exchange term $Q_{int}$ which is one of the parts of the source term $Q_{enth}$ of the heat equation.

The method according to the invention which thus allows modeling of the composition variation of a mixture with a limited number of components in space and in time has been experimentally validated on real cases.

We claim:

1. A method for determining flow conditions of steady and transient flows of a multiphase mixture in a pipe positioned with respect to terrain, comprising:

providing a hydrodynamic model of a drift flow type and an integrated thermodynamic model for defining properties of constituents of the multiphase mixture and solving a set of equations of mass conservation, momentum conservation and energy transfer in the multiphase mixture including an effect of gravity resulting in slugging effects due to the terrain having an irregular geometry, the model being formed with the multiphase mixture considered to be substantially at equilibrium at all times and a composition of the multiphase mixture being variable all along the pipe, mass of each constituent of the multiphase mixture being defined by a mass conservation equation for each constituent of the multiphase mixture regardless of a phase state thereof and using a time explicit numerical scheme to separate resolution of the thermodynamic model and the hydrodynamic model; and using the model to determine characteristics of flow of the multiphase mixture in the pipe.

2. A method for determining flow conditions of steady and transient flows of a multiphase mixture in a pipe positioned with respect to terrain, comprising:

providing a hydrodynamic model of a drift flow type and an integrated thermodynamic model for defining properties of the constituents of the multiphase mixture and solving a set of equations of mass conservation, momentum conservation and energy transfer in the multiphase mixture including an effect of gravity resulting in slugging effects due to the terrain having an irregular geometry, the model being formed with the multiphase mixture considered to be substantially at equilibrium at all times and a composition of the multiphase mixture being variable all along the pipe, mass of each constituent of the mixture being defined by a mass conservation equation for each constituent of the multiphase mixture regardless of a phase state thereof and using a time explicit numerical scheme to separate resolution of the thermodynamic model and the hydrodynamic model;

the multiphase mixture being represented as a mixture made up of a limited number of components in the multiphase mixture; and using the model to determine characteristics of flow of the multiphase mixture in the pipe.

3. A method as claimed in claim 2, wherein the representing of multi-component mixtures is by equivalent binary mixtures.

4. A method as claimed in claim 1, comprising solving energy transfer equations uncoupled from the mass conservation and momentum equations.

5. A method as claimed in claim 2, comprising solving energy transfer equations uncoupled from the mass conservation and momentum equations.

6. A method as claimed in claim 1, comprising using an integrated and optimized module for directly determining thermodynamic parameters defining phase equilibrium and transport properties of the mixture.

7. A method as claimed in claim 2, comprising using an integrated and optimized module for directly determining thermodynamic parameters defining phase equilibrium and transport properties of the mixture.

* * * * *